US011410615B2

(12) United States Patent
Su et al.

(10) Patent No.: US 11,410,615 B2
(45) Date of Patent: Aug. 9, 2022

(54) PIXEL DRIVING CIRCUIT, DISPLAY PANEL AND DISPLAY DEVICE

(71) Applicant: Shenzhen China Star Optoelectronics Semiconductor Display Technology Co., Ltd., Guangdong (CN)

(72) Inventors: Huasheng Su, Guangdong (CN); Jianhang Fu, Guangdong (CN)

(73) Assignee: Shenzhen China Star Optoelectronics Semiconductor Display Technology Co., Ltd., Shenzhen (CN)

( * ) Notice: Subject to any disclaimer, the term of this patent is extended or adjusted under 35 U.S.C. 154(b) by 98 days.

(21) Appl. No.: 17/054,522

(22) PCT Filed: Aug. 4, 2020

(86) PCT No.: PCT/CN2020/106724

§ 371 (c)(1),
(2) Date: Nov. 11, 2020

(87) PCT Pub. No.: WO2022/000695

PCT Pub. Date: Jan. 6, 2022

(65) Prior Publication Data

US 2022/0189414 A1 Jun. 16, 2022

(30) Foreign Application Priority Data

Jul. 2, 2020 (CN) ..... 202010628792.2

(51) Int. Cl.
*G09G 3/3291* (2016.01)

(52) U.S. Cl.
CPC ... *G09G 3/3291* (2013.01); *G09G 2310/0262* (2013.01); *G09G 2310/08* (2013.01); *G09G 2320/045* (2013.01)

(58) Field of Classification Search
CPC ..... G09G 2320/0626; G09G 2320/064; G09G 2320/0276; G09G 2320/0242;
(Continued)

(56) References Cited

U.S. PATENT DOCUMENTS 10,600,356 B1 3/2020 Lee et al.
2003/0174152 A1* 9/2003 Noguchi ..... G09G 3/3233 345/690

(Continued)

FOREIGN PATENT DOCUMENTS

CN 1595477 3/2005
CN 101437341 5/2009

(Continued)

*Primary Examiner* — Dong Hui Liang

(57) ABSTRACT

A pixel driving circuit, a display panel and a display device are provided. The pixel driving circuit includes a first control module electrically connected to a first node. The first control module receives the first control signal and the first power voltage. The first control module is used to write the first power voltage into the first node under the control of the first control signal when the voltage of the first control signal is higher than the first predetermined threshold voltage. Because the first power voltage is written into the first node to control the lighting device to generate light when the first control signal is higher than the first predetermined threshold voltage, this could prevent the lighting device from generating the color shift. In this way, the requirement for the chip performance is comparatively low and thus the manufacturing cost is reduced.

20 Claims, 4 Drawing Sheets

(58) Field of Classification Search
CPC ... G09G 2320/0285; G09G 2320/0666; G09G 2320/0646; G09G 2320/0233; G09G 2320/0223; G09G 2320/0247; G09G 2320/066; G09G 3/3406; G09G 3/36; G09G 3/22; G09G 3/3611; G09G 3/2014; G09G 3/3413; G09G 3/32; G09G 3/2003; G09G 2360/145; G09G 2360/16; G09G 2300/0452
See application file for complete search history.

(56) References Cited

U.S. PATENT DOCUMENTS

| | | | | |
|---|---|---|---|---|
| 2009/0021536 | A1* | 1/2009 | Abe | G09G 3/325 345/77 |
| 2019/0259325 | A1* | 8/2019 | Chaji | G06T 7/90 |

FOREIGN PATENT DOCUMENTS

| | | |
|---|---|---|
| CN | 106469539 | 3/2017 |
| CN | 107481662 | 12/2017 |
| CN | 109872686 | 6/2019 |
| CN | 109920371 | 6/2019 |
| CN | 110010057 | 7/2019 |
| CN | 110021263 | 7/2019 |
| CN | 110782831 | 2/2020 |
| CN | 210378422 | 4/2020 |
| CN | 111223444 | 6/2020 |
| CN | 111243514 | 6/2020 |
| CN | 111326101 | 6/2020 |

* cited by examiner

PIXEL DRIVING CIRCUIT, DISPLAY PANEL AND DISPLAY DEVICE

RELATED APPLICATIONS

This application is a National Phase of PCT Patent Application No. PCT/CN2020/106724 having International filing date of Aug. 4, 2020, which claims the benefit of priority of Chinese Patent Application No. 202010628792.2 filed on Jul. 2, 2020. The contents of the above applications are all incorporated by reference as if fully set forth herein in their entirety.

FIELD AND BACKGROUND OF THE INVENTION

The present invention relates to a display technique, and more particularly, to a pixel driving circuit, a display panel and a display device.

The light spectrum of a lighting device shifts under different current densities. Taking a micro-LED as an example, the generated light variation is in a U-shape under the measurement of The Light Ports Integrating Sphere. The variation is shown in FIG. 1. The x-axis represents the current (mA) and the y-axis represents the peak wavelength (nm). This phenomenon occurs in most of lighting devices.

When the spectrum shifts, the lighting device generates a color shift. Conventionally, the pulse width modulation is used to control the lighting time of the lighting device so as to control the luminance and improve the color shift. However, this solution needs to perform multiple full scans in one frame. This shortens the scan time. For doing so, the chip needs to have a better processing speed and thus the manufacturing cost is higher.

SUMMARY OF THE INVENTION

One objective of an embodiment of the present invention is to provide a pixel driving circuit, a display panel and a display device to solve the above-mentioned issue.

According to an embodiment of the present invention, a pixel driving circuit is disclosed. The pixel driving circuit is configured to drive a lighting device to generate light. The pixel driving circuit comprises: a driving transistor, having a gate, a source and a drain, wherein the drain of the driving transistor is electrically connected to a first end of the lighting device; a data writing module, electrically connected to the gate of the driving transistor, configured to receive a scan signal and a data signal and to write the data signal to the gate of the driving transistor under a control of the scan signal; a first control module, electrically connected to a first node, configured to receive a first control signal and a first power voltage and to write the first power voltage into the first node under a control of the first control signal when the first control signal is larger than a first predetermined threshold voltage; a compensation module, electrically connected to the source of the driving transistor, configured to receive a third power voltage and to input the third power voltage to the source of the driving transistor under a control of the first power voltage, wherein the third power voltage is higher than the first power voltage; and a first storage module; wherein a second end of the lighting device is electrically connected to a ground.

According to an embodiment of the present invention, a display panel is disclosed. The display panel comprises the above-mentioned pixel driving circuit.

According to an embodiment of the present invention, a display device is disclosed. The display device comprises the above-mentioned display panel.

The pixel driving circuit, the display panel and the display device according to an embodiment of the present invention comprise a first control module electrically connected to a first node. The first control module receives the first control signal and the first power voltage. The first control module is used to write the first power voltage into the first node under the control of the first control signal when the voltage of the first control signal is higher than the first predetermined threshold voltage. Because the first power voltage is written into the first node to control the lighting device to generate light when the first control signal is higher than the first predetermined threshold voltage, this could prevent the lighting device from generating the color shift. In this way, the requirement for the chip performance is comparatively low and thus the manufacturing cost is reduced.

BRIEF DESCRIPTION OF THE SEVERAL VIEWS OF THE DRAWINGS

To describe the technical solutions in the embodiments of this application more clearly, the following briefly introduces the accompanying drawings required for describing the embodiments. Apparently, the accompanying drawings in the following description show merely some embodiments of this application, and a person of ordinary skill in the art may still derive other drawings from these accompanying drawings without creative efforts.

DETAILED DESCRIPTION OF PREFERRED SPECIFIC EMBODIMENTS OF THE INVENTION

Figure 1:
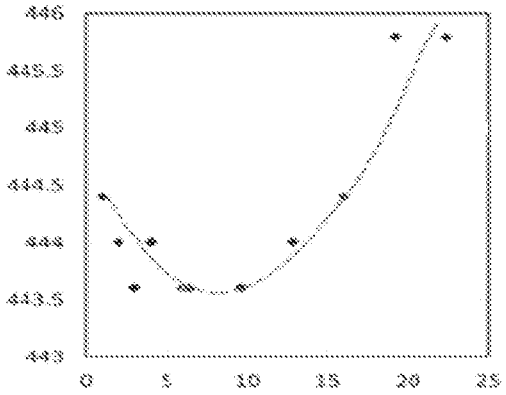
Fig. 1 (Related art)
FIG. 1 is a diagram showing a relationship between the current and the peak wavelength.

To help a person skilled in the art better understand the solutions of the present disclosure, the following clearly and completely describes the technical solutions in the embodiments of the present invention with reference to the accompanying drawings in the embodiments of the present invention. Apparently, the described embodiments are a part rather than all of the embodiments of the present invention. All other embodiments obtained by a person of ordinary skill in the art based on the embodiments of the present invention without creative efforts shall fall within the protection scope of the present disclosure.

It is understood that terminologies, such as "center," "longitudinal," "horizontal," "length," "width," "thickness,"

"upper," "lower," "before," "after," "left," "right," "vertical," "horizontal," "top," "bottom," "inner," "outer," "clockwise," and "counterclockwise," are locations and positions regarding the figures. These terms merely facilitate and simplify descriptions of the embodiments instead of indicating or implying the device or components to be arranged on specified locations, to have specific positional structures and operations. These terms shall not be construed in an ideal or excessively formal meaning unless it is clearly defined in the present specification. In addition, the term "first", "second" are for illustrative purposes only and are not to be construed as indicating or imposing a relative importance or implicitly indicating the number of technical features indicated. Thus, a feature that limited by "first", "second" may expressly or implicitly include at least one of the features. In the description of the present disclosure, the meaning of "plural" is two or more, unless otherwise specifically defined.

All of the terminologies containing one or more technical or scientific terminologies have the same meanings that persons skilled in the art understand ordinarily unless they are not defined otherwise. For example, "arrange," "couple," and "connect," should be understood generally in the embodiments of the present disclosure. For example, "firmly connect," "detachably connect," and "integrally connect" are all possible. It is also possible that "mechanically connect," "electrically connect," and "mutually communicate" are used. It is also possible that "directly couple," "indirectly couple via a medium," and "two components mutually interact" are used.

All of the terminologies containing one or more technical or scientific terminologies have the same meanings that persons skilled in the art understand ordinarily unless they are not defined otherwise. For example, "upper" or "lower" of a first characteristic and a second characteristic may include a direct touch between the first and second characteristics. The first and second characteristics are not directly touched; instead, the first and second characteristics are touched via other characteristics between the first and second characteristics. Besides, the first characteristic arranged on/above/over the second characteristic implies that the first characteristic arranged right above/obliquely above or merely means that the level of the first characteristic is higher than the level of the second characteristic. The first characteristic arranged under/below/beneath the second characteristic implies that the first characteristic arranged right under/obliquely under or merely means that the level of the first characteristic is lower than the level of the second characteristic.

Different methods or examples are introduced to elaborate different structures in the embodiments of the present disclosure. To simplify the method, only specific components and devices are elaborated by the present disclosure. These embodiments are truly exemplary instead of limiting the present disclosure. Identical numbers and/or letters for reference are used repeatedly in different examples for simplification and clearance. It does not imply that the relations between the methods and/or arrangement. The methods proposed by the present disclosure provide a variety of examples with a variety of processes and materials. However, persons skilled in the art understand ordinarily that the application of other processes and/or the use of other kinds of materials are possible.

Figure 2:
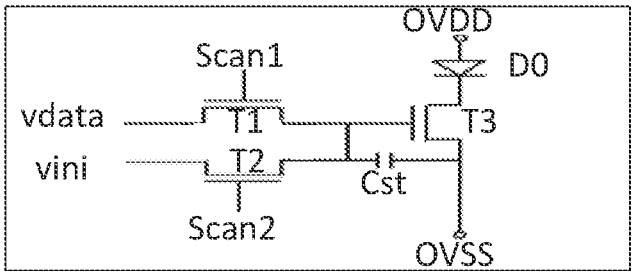
FIG. 2 is a diagram of a conventional pixel driving circuit.

As shown in FIG. 2, the conventional pixel driving circuit comprises: a first transistor T1, a second transistor T2 and a third transistor T3. The gate of the first transistor T1 receives the first scan signal Scan1. The source of the first transistor T1 receives the data signal vdata. The drain of the first transistor T1 is electrically connected to one end of the storage capacitor Cst and the gate of the third transistor T3. The gate of the second transistor T2 receives the second scan signal Scan2. The source of the second transistor T2 receives vini. The drain of the second transistor T2 is electrically connected to one end of the storage capacitor Cst and the gate of the third transistor T3. The source of the third transistor T3 is electrically connected to the cathode of the lighting device D0. The anode of the lighting device D0 receives the high power voltage OVDD. The drain of the third transistor T3 receives the low power voltage OVSS. When the first transistor T1 is turned on, the data signal vdata is inputted into the gate of the third transistor T3. So, the third transistor T3 is turned on and the lighting device D0 generates light. When the second transistor T2 is turned on, vini is inputted into the gate of the third transistor T3. Thus, the third transistor T3 is turned off and the lighting device D0 does not generate light. Here, the voltage level of vini is opposite to the voltage level of the data signal vdata.

Figure 3:
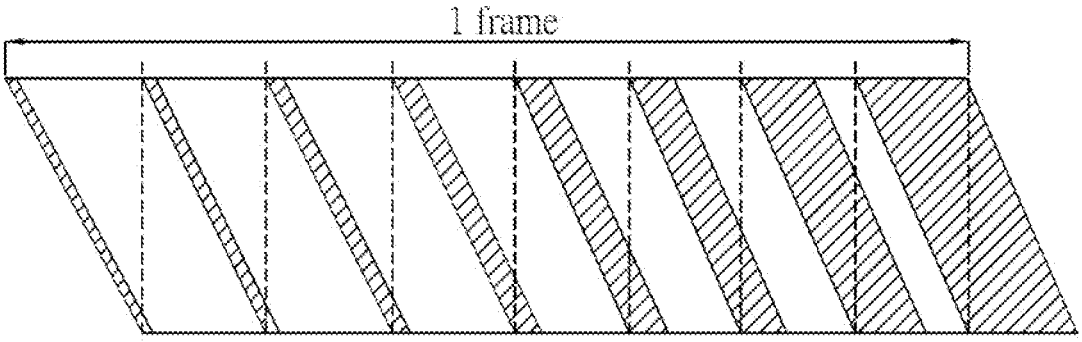
FIG. 3 is a driving timing diagram of the conventional pixel driving circuit shown in FIG. 2.

As shown in FIG. 3, conventionally, the display panel is scanned once per one frame. However, in the pulse width modulation (PWM) mode, eight full scans are performed in one frame. Because the time for one frame is fixed, each PWM scan time is very short. In this way, the chip needs to support this high scanning speed. This means that the chip needs to send the data in a higher speed and has a wider bandwidth. If the display panel has a low resolution, this means the scanning speed could be lower because the lines to be scanned are fewer. If the display panel has a high resolution, the scanning speed needs to be much higher. Therefore, the scanning speed of the chip becomes a limitation of the display panel such that the resolution of the display panel is limited by the chip.

Figure 4:
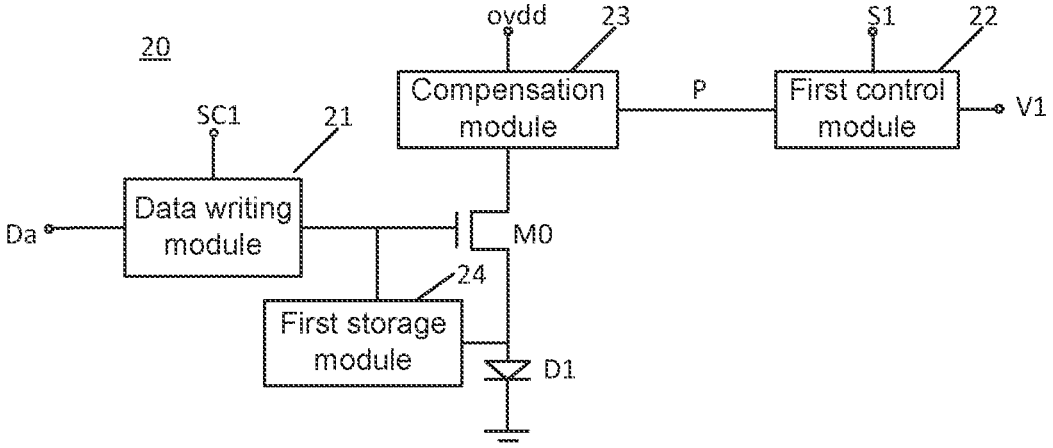
FIG. 4 is a diagram of a pixel driving circuit according to an embodiment of the present invention.

Please refer to FIG. 4. FIG. 4 is a diagram of a pixel driving circuit according to an embodiment of the present invention. In this embodiment, the pixel driving circuit 20 is used to drive a lighting device to generate light. The pixel driving circuit 20 comprises a data writing module 21, a driving transistor M0, a first control module 22, and a compensation module 23. In an embodiment, the pixel driving circuit 20 further comprises a first storage module 24.

The data writing module 21 receives the scan signal SC1 and a data signal Da. The data writing module 21 is electrically connected to the gate of the driving transistor M0. The data writing module 21 is used to write the data signal Da into the gate of the driving transistor M0 under the control of the scan signal SC1.

The first control module 22 is electrically connected to the first node P. The first control module 22 receives the first control signal S1 and the first power voltage V1. The first control module 22 is used to write the first power voltage V1 into the first node P under the control of the first control signal S1 when the first control signal S1 is higher than the first predetermined threshold voltage.

The compensation module 23 is electrically connected to the first node P and the source of the driving transistor M0. The compensation module 23 receives the third power voltage ovdd. The compensation module 23 is used to input the third power voltage ovdd into the source of the driving transistor M0 under the control the first power voltage V1. The third power voltage ovdd is higher than the first power voltage V1.

The drain of the driving transistor M0 is electrically connected to the first end of the lighting device D1. The second end of the lighting device D1 is electrically connected to the ground. In an embodiment, the first end is a cathode. The second is the anode.

The first storage module 24 is used to store the data signal Da.

Figure 5:
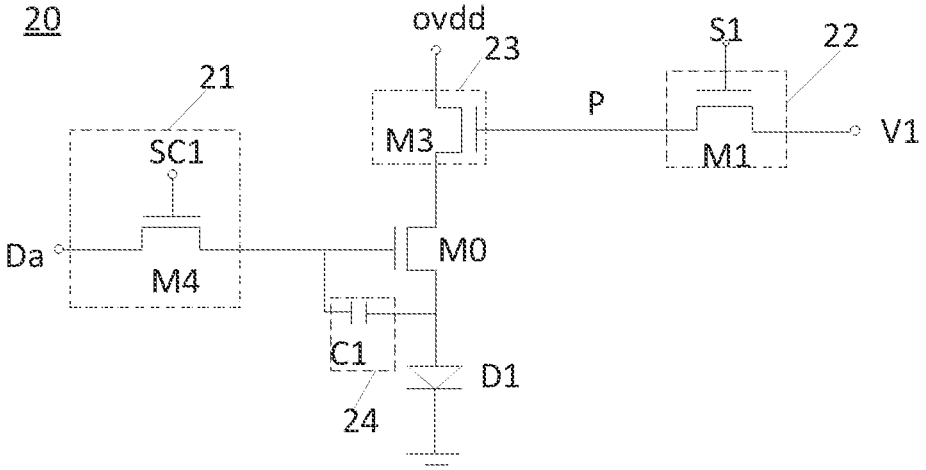
FIG. 5 is a diagram of a pixel driving circuit according to another embodiment of the present invention.

As shown in FIG. 5, the data writing module 21 comprises a fourth transistor M4. The gate of the fourth transistor M4 receives the data signal Da. The drain of the fourth transistor M4 is electrically connected to the gate of the driving transistor M0.

The first control module 22 comprises a first transistor M1. The gate of the first transistor M1 receives the first control signal S1. The source of the first transistor M1 receives the first power voltage V1. The drain of the first transistor M1 is electrically connected to the first node P.

The compensation module 23 comprises a third transistor M3. The gate of the third transistor M3 is electrically connected to the first node P. The source of the third transistor M3 receives the third power voltage ovdd. The drain of the third transistor M3 is electrically connected to the source of the driving transistor M0. The third power voltage ovdd is higher than the first power voltage V1.

The first storage module 24 comprises a first capacitor C1. The two ends of the first capacitor C1 are respectively connected to the drain of the fourth transistor M4 and the first end of the lighting device.

The above-mentioned lighting device D1 could be one of an organic LED, a micro LED or a mini OLED.

Please note, the structure shown in FIG. 5 is only an example, not a limitation of the present invention.

In order to raise the conductivity, the first transistor, the second transistor, the third transistor, the fourth transistor, and the driving transistor are MOSFETs.

Figure 6:
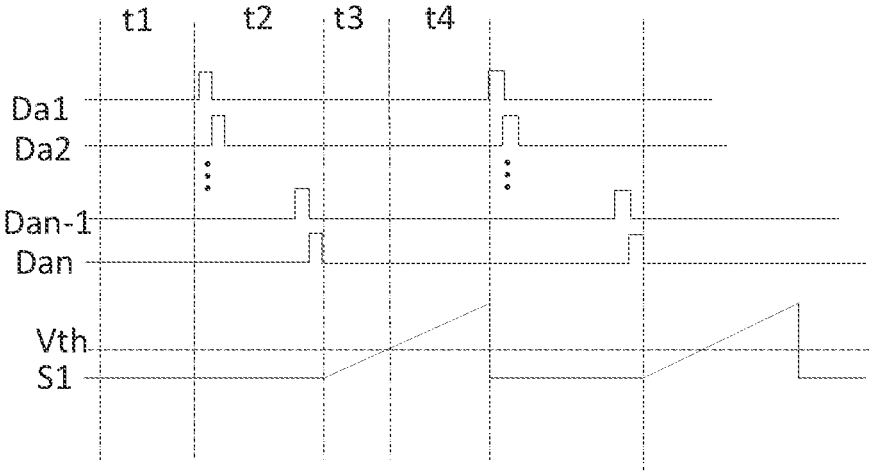
FIG. 6 is a timing diagram of the pixel driving circuit shown in FIG. 5 according to an embodiment of the present invention.

As shown in FIG. 6, the first transistor, the second transistor, the third transistor, the fourth transistor, and the driving transistor are N-type transistors in this embodiment. Here, the data signals Da1-Dan represent the data signals inputted into the lighting devices in the lines 1-*n*, where n is an integer. In the following disclosure, the working mechanism of the pixel driving circuit is illustrated:

In the initial stage (t1 stage), all the signals are initiated. That is, the entire pixel driving circuit is in the initial stage.

In the compensation stage (t2 stage), the fourth transistor M4 is turned on. The data signal Da is written into the gate of the driving transistor M0. At this time the first control signal S1 corresponds to a low voltage level and thus the first transistor M1 cuts off. This causes the third transistor M3 to cut off. The lighting device D1 does not generate light.

In the control stage (t3 stage), the fourth transistor M4 is turned off. At this time, the first control signal S1 is pulled up. Because the maximum of the first control signal S1 in this stage is comparatively low (the voltage difference Vgs between the gate and the source of the first transistor M1 is lower than the threshold voltage Vth), the first transistor M1 cuts off. This causes the third transistor M3 to cut off. The lighting device D1 does not generate light.

In the lighting stage (t4 stage), the first control signal S1 keeps being pulled up. At this time, the first control signal S1 becomes higher than the first predetermined threshold voltage. That is, the minimum of the first control signal S1 is comparatively high (the voltage difference Vgs between the gate and the source of the first transistor M1 is higher than the threshold voltage Vth). Thus, the first transistor M1 is turned on and the third transistor M3 is turned on. Therefore, the lighting device generates light.

Therefore, through controlling the first control voltage S1, the voltage difference Vgs between the gate and the source of the first transistor M1 could be controlled and the lighting time of the lighting device is therefore controlled.

According to the present invention, the transistors are not limited to be N-type transistors. In the actual implementation, the transistors could be P-type transistors. When the transistors are P-type transistors, the phase of each of the signals shown in FIG. 6 could be adjusted according to the functions of the transistors and each of the modules. For example, when the first transistor M1, the third transistor M3, the fourth transistor M4 and the driving transistor M0 are all P-type transistors, the phases of the first control signal S1, the first power voltage V1, the scan signal SC1, and the data signal Da become inverted phases of the signals shown in FIG. 6.

The present invention further provides a pixel driving method, which could be applied in the pixel driving circuit of any one of the above-mentioned embodiments. In a frame period, the pixel driving method orderly comprises the compensation stage, the control stage, and the lighting stage.

S101: The compensation stage: under the control of the data writing module, the data voltage is written into the gate of the driving transistor.

S102: The control stage: the first control voltage is getting higher.

S103: The lighting stage: the first control voltage keeps getting higher. When the first control voltage is higher than the first predetermined threshold voltage, the first power voltage is written into the first node under the control of the first control module. In addition, under the control of the first power voltage, the third power voltage is written into the source of the driving transistor such that the lighting device generates light.

In the control stage, the maximum of the first control voltage is lower than the first predetermined threshold voltage. In the lighting stage, the minimum of the first control voltage is higher than the first predetermined threshold voltage. The first predetermined threshold voltage could be the threshold voltage Vth of the first transistor M1.

When the voltage difference Vgs between the gate and the source of the first transistor M1 is controlled to be higher than the threshold voltage Vth, the lighting device generates light. This could achieve the luminance control of the lighting device. When the third transistor M3 is turned on, the third power voltage ovdd and the first power voltage V1 are constant voltages. This makes the current flowing through the lighting devices constant. Because of this, the color shift is avoided. In addition, because no PWM modulation is required, the charging time could be longer. This reduces the performance requirement of the chip and thus also reduces the manufacturing cost. When the data voltage is high enough, the current is not sensitive according to the threshold voltage. Therefore, the shift issue or the compensation issue of the threshold voltage Vth of the transistors can be ignored.

Figure 7:
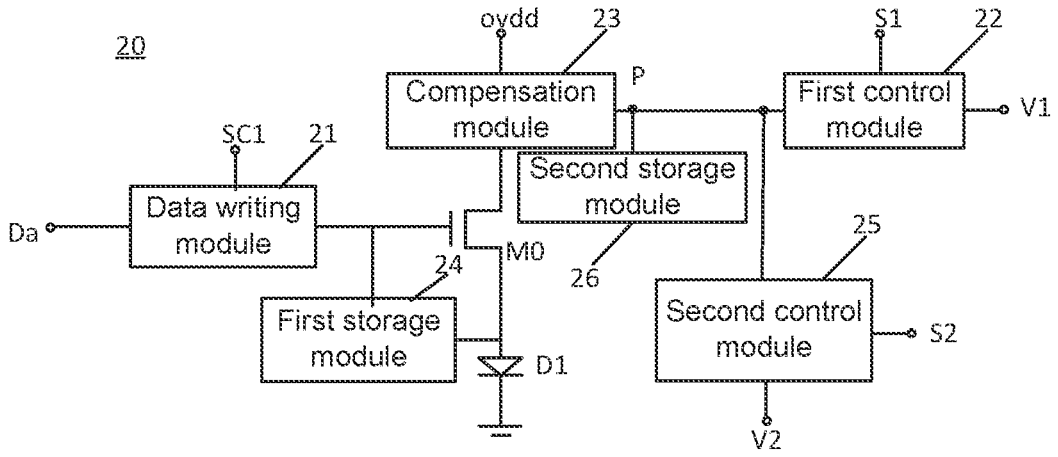
FIG. 7 is a diagram of a pixel driving circuit according to another embodiment of the present invention.

Please refer to FIG. 7. FIG. 7 is a diagram of a pixel driving circuit according to another embodiment of the present invention.

The pixel driving circuit 20 further comprises a second control module 25. In an embodiment, the pixel driving circuit 20 could further comprise a second storage module 26.

The second control module 25 is electrically connected to the first node P. the second control module 26 receives the second control signal S2 and the second power voltage V2. The second control module 26 is used to write the second power voltage V2 into the first node under the control of the second control signal S2.

The first power voltage V1 is higher than the second power voltage V2. The second power voltage V2 is lower than the second predetermined threshold voltage. That is, the second power voltage V2 is lower than the threshold voltage of the third transistor M3. The second predetermined threshold voltage is the threshold voltage of the third transistor M3.

The second storage module 26 is electrically connected to the first node. The second storage module 25 is used to store the first power voltage V1 or the second power voltage V2.

Figure 8:
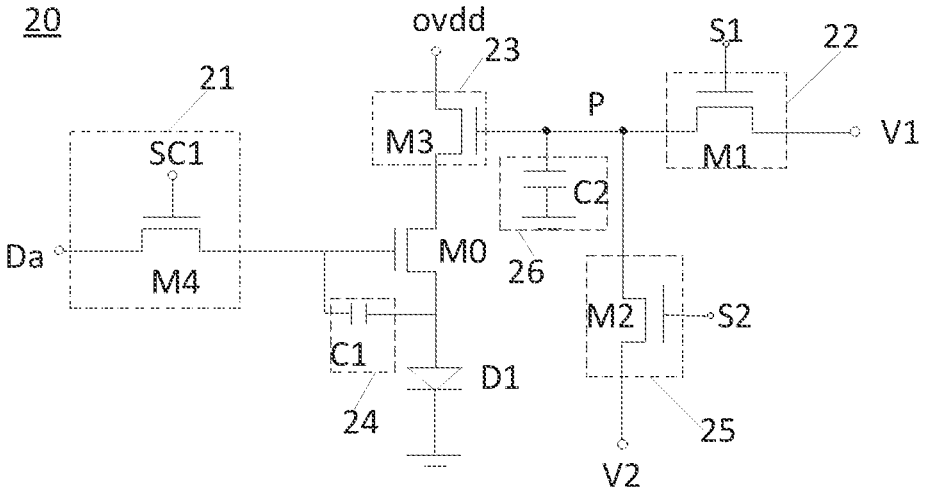
FIG. 8 is a diagram of a pixel driving circuit according to another embodiment of the present invention.

As shown in FIG. 8, the second control module 25 comprises a second transistor M2. The gate of the second transistor M2 receives the second control signal S2. The source of the second transistor M2 receives the second power voltage V2. The drain of the second transistor M2 is electrically connected to the first node P.

The second storage module 26 comprises a second capacitor C2. One end of the second capacitor C2 is electrically connected to the first node P. Another end of the second capacitor C2 is electrically connected to the ground.

Please note, the structure shown in FIG. 8 is only an example, not a limitation of the present invention.

In order to raise the conductivity, the first transistor, the second transistor, the third transistor, the fourth transistor, and the driving transistor are MOSFETs.

Figure 9:
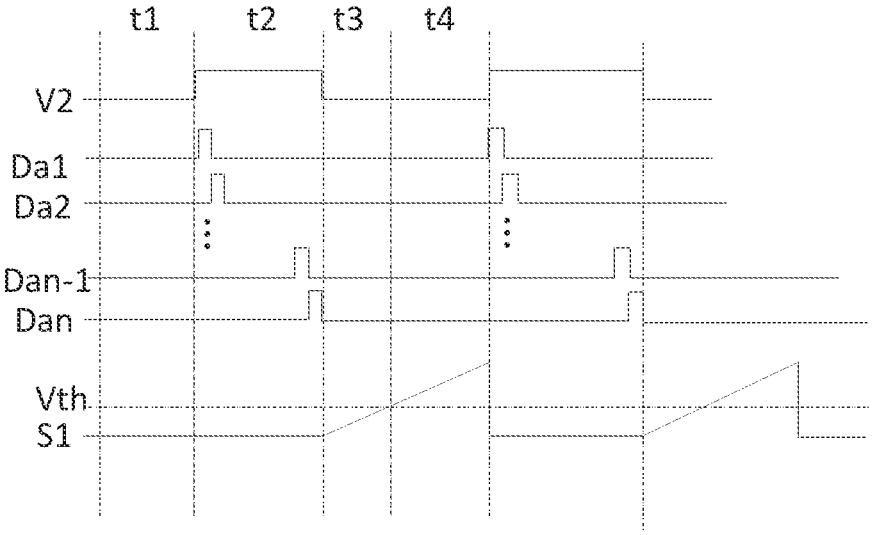
FIG. 9 is a timing diagram of the pixel driving circuit shown in FIG. 8 according to an embodiment of the present invention.

As shown in FIG. 9, the first transistor, the second transistor, the third transistor, the fourth transistor, and the driving transistor are N-type transistors in this embodiment. Here, the data signals Da1-Dan represent the data signals inputted into the lighting devices in the lines 1-*n*, where n is an integer. In the following disclosure, the working mechanism of the pixel driving circuit is illustrated:

In the initial stage (t1 stage), all the signals are initiated. That is, the entire pixel driving circuit is in the initial stage.

In the compensation stage (t2 stage), the fourth transistor M4 is turned on. The data signal Da is written into the gate of the driving transistor M0. The second transistor M2 is turned on and the power voltage V2 is written into the first node to provide an initial voltage level to the second capacitor C2. At this time the first control signal S1 corresponds to a low voltage level and thus the first transistor M1 cuts off. This causes the third transistor M3 to cut off. The lighting device D1 does not generate light.

In the control stage (t3 stage), the fourth transistor M4 and the second transistor M2 are turned off. At this time, the first control signal S1 is pulled up. Because the maximum of the first control signal S1 in this stage is comparatively low (the voltage difference Vgs between the gate and the source of the first transistor M1 is lower than the threshold voltage Vth), the first transistor M1 cuts off. This causes the third transistor M3 to cut off. The lighting device D1 does not generate light.

In the lighting stage (t4 stage), the first control signal S1 keeps being pulled up. At this time, the first control signal S1 becomes higher than the first predetermined threshold voltage. That is, the minimum of the first control signal S1 is comparatively high (the voltage difference Vgs between the gate and the source of the first transistor M1 is higher than the threshold voltage Vth). Thus, the first transistor M1 is turned on and the third transistor M3 is turned on. Therefore, the lighting device generates light.

Therefore, through controlling the time when the voltage difference Vgs between the gate and the source of the first transistor M1 reaches the threshold voltage Vth, and the lighting time of the lighting device is therefore controlled.

According to the present invention, the transistors are not limited to be N-type transistors. In the actual implementation, the transistors could be P-type transistors. When the transistors are P-type transistors, the phase of each of the signals shown in FIG. 9 could be adjusted according to the functions of the transistors and each of the modules. For example, when the first transistor M1, the second transistor M2, the third transistor M3, the fourth transistor M4 and the driving transistor M0 are all P-type transistors, the phases of the first control signal S1, the second control signal S2, the first power voltage V1, the second power voltage V2, the scan signal SC1, and the data signal Da become inverted phases of the signals shown in FIG. 9.

Because the second control module is added, the rising time of the gate voltage of the third transistor M3 could be reduced. The charging efficiency is raised. In addition, when the second storage module is added, the second control module could turn off the third transistor M3 more quickly.

The present invention further provides a pixel driving method, which could be applied in the pixel driving circuit of any one of the above-mentioned embodiments. In a frame period, the pixel driving method orderly comprises the compensation stage, the control stage, and the lighting stage.

S101: The compensation stage: Under the control of the data writing module, the data voltage is written into the gate of the driving transistor. In addition, the second power voltage is written into the first node under the control of the second control module.

S102: The control stage: The first control voltage is getting higher.

S103: The lighting stage: The first control voltage keeps getting higher. When the first control voltage is higher than the first predetermined threshold voltage, the first power voltage is written into the first node under the control of the first control module. In addition, under the control of the first power voltage, the third power voltage is written into the source of the driving transistor such that the lighting device generates light.

In the control stage, the maximum of the first control voltage is lower than the first predetermined threshold voltage. In the lighting stage, the minimum of the first control voltage is higher than the first predetermined threshold voltage. The first predetermined threshold voltage could be the threshold voltage Vth of the first transistor M1.

According to an embodiment of the present invention, a display panel is disclosed. The display panel comprises a pixel driving circuit of any one of the above-mentioned embodiments.

According to an embodiment of the present invention, a display device is disclosed. The display device comprises a display panel of any one of the above-mentioned embodiments. Please note, the display device could be a E-paper, a cell phone, a tablet, a TV, a laptop, a digital frame, a navigator, a wearable equipment, or any other products/devices having 2D/3D display functions.

Through controlling the rising slope of the first control voltage, the time for the voltage difference Vgs to reach the threshold voltage Vth could be controlled to control the lighting time of the lighting device. Through controlling the voltage difference Vgs between the gate and the source of the control device M1 to be higher or equal to the threshold voltage Vth, the luminance of the lighting device is controlled. When the third transistor M3 is turned on, the third power voltage ovdd and the first power voltage V1 are constant voltages. This makes the current flowing through the lighting devices constant. Because of this, the wavelength shift of the lighting device is solved and thus the color shift issue is avoided. In addition, because no PWM modulation is required, the charging time could be longer. This reduces the performance requirement of the chip and thus also reduces the manufacturing cost. When the data voltage is high enough, the current is not sensitive according to the threshold voltage. Therefore, the shift issue or the compensation issue of the threshold voltage Vth of the transistors can be ignored.

In this embodiment, the detailed driving method of the pixel driving circuit is similar to the above-mentioned embodiments and thus omitted here.

The pixel driving circuit, the display panel and the display device according to an embodiment of the present invention comprise a first control module electrically connected to a first node. The first control module receives the first control signal and the first power voltage. The first control module is used to write the first power voltage into the first node under the control of the first control signal when the voltage of the first control signal is higher than the first predetermined threshold voltage. Because the first power voltage is written into the first node to control the lighting device to generate light when the first control signal is higher than the first predetermined threshold voltage, this could prevent the lighting device from generating the color shift. In this way, the requirement for the chip performance is comparatively low and thus the manufacturing cost is reduced.

Above are embodiments of the present invention, which does not limit the scope of the present invention. Any modifications, equivalent replacements or improvements within the spirit and principles of the embodiment described above should be covered by the protected scope of the invention.

What is claimed is:

1. A pixel driving circuit, configured to drive a lighting device to generate light, the pixel driving circuit comprising:

a driving transistor, having a gate, a source and a drain, wherein the drain of the driving transistor is electrically connected to a first end of the lighting device;

a data writing module, electrically connected to the gate of the driving transistor, configured to receive a scan signal and a data signal and to write the data signal to the gate of the driving transistor under a control of the scan signal;

a first control module, electrically connected to a first node, configured to receive a first control signal and a first power voltage and to write the first power voltage into the first node under a control of the first control signal when the first control signal is larger than a first predetermined threshold voltage;

a compensation module, electrically connected to the source of the driving transistor, configured to receive a third power voltage and to input the third power voltage to the source of the driving transistor under a control of the first power voltage, wherein the third power voltage is higher than the first power voltage; and a first storage module;

wherein a second end of the lighting device is electrically connected to a ground.

2. The pixel driving circuit of claim 1, further comprising:

a second control module, electrically connected to the first node, configured to receive a second control signal and a second power voltage and to write the second power voltage into the first node under a control of the second control signal;

wherein the second power voltage is lower than a second threshold voltage and the first power voltage is higher than the second power voltage.

3. The pixel driving circuit of claim 2, wherein the pixel driving circuit further comprises:

a second storage module, electrically connected to the first node, configured to store the first power voltage or the second power voltage.

4. The pixel driving circuit of claim 3, wherein the second storage module comprises:

a second capacitor, having one end electrically connected to the first node and another end electrically connected to a ground.

5. The pixel driving circuit of claim 2, wherein the second control module comprises:

a second transistor, having a gate receiving the second control signal, a source receiving the second power voltage, and a drain electrically connected to the first node.

6. The pixel driving circuit of claim 1, wherein the first control module comprises:

a first transistor, having a gate receiving the first control signal, a source receiving the first power voltage, and a drain electrically connected to the first node.

7. The pixel driving circuit of claim 1, wherein the compensation module comprises:

a third transistor, having a gate electrically connected to the first node, a source receiving the third power voltage, and a drain electrically connected to the source of the driving transistor.

8. A display panel, comprising a pixel driving circuit configured to drive a lighting device to generate light, the pixel driving circuit comprising:

a driving transistor, having a gate, a source and a drain, wherein the drain of the driving transistor is electrically connected to a first end of the lighting device;

a data writing module, electrically connected to the gate of the driving transistor, configured to receive a scan signal and a data signal and to write the data signal to the gate of the driving transistor under a control of the scan signal;

a first control module, electrically connected to a first node, configured to receive a first control signal and a first power voltage and to write the first power voltage into the first node under a control of the first control signal when the first control signal is larger than a first predetermined threshold voltage;

a compensation module, electrically connected to the source of the driving transistor, configured to receive a third power voltage and to input the third power voltage to the source of the driving transistor under a control of the first power voltage, wherein the third power voltage is higher than the first power voltage; and a first storage module;

wherein a second end of the lighting device is electrically connected to a ground.

9. The display panel of claim 8, wherein the further pixel driving circuit comprises:

a second control module, electrically connected to the first node, configured to receive a second control signal and a second power voltage and to write the second power voltage into the first node under a control of the second control signal;

wherein the second power voltage is lower than a second threshold voltage and the first power voltage is higher than the second power voltage.

10. The display panel of claim 9, wherein the pixel driving circuit further comprises:

a second storage module, electrically connected to the first node, configured to store the first power voltage or the second power voltage.

11. The display panel of claim 10, wherein the second storage module comprises:

a second capacitor, having one end electrically connected to the first node and another end electrically connected to a ground.

12. The display panel of claim 9, wherein the second control module comprises:

a second transistor, having a gate receiving the second control signal, a source receiving the second power voltage, and a drain electrically connected to the first node.

13. The display panel of claim 8, wherein the first control module comprises:

a first transistor, having a gate receiving the first control signal, a source receiving the first power voltage, and a drain electrically connected to the first node.

14. The display panel of claim 8, wherein the compensation module comprises:

a third transistor, having a gate electrically connected to the first node, a source receiving the third power voltage, and a drain electrically connected to the source of the driving transistor.

15. A display device, comprising a display panel having a pixel driving circuit configured to drive a lighting device to generate light, the pixel driving circuit comprising:

a driving transistor, having a gate, a source and a drain, wherein the drain of the driving transistor is electrically connected to a first end of the lighting device;

a data writing module, electrically connected to the gate of the driving transistor, configured to receive a scan signal and a data signal and to write the data signal to the gate of the driving transistor under a control of the scan signal;

a first control module, electrically connected to a first node, configured to receive a first control signal and a first power voltage and to write the first power voltage into the first node under a control of the first control signal when the first control signal is larger than a first predetermined threshold voltage;

a compensation module, electrically connected to the source of the driving transistor, configured to receive a third power voltage and to input the third power voltage to the source of the driving transistor under a control of the first power voltage, wherein the third power voltage is higher than the first power voltage; and a first storage module;

wherein a second end of the lighting device is electrically connected to a ground.

16. The display device of claim 15, wherein the pixel driving circuit further comprises:

a second control module, electrically connected to the first node, configured to receive a second control signal and a second power voltage and to write the second power voltage into the first node under a control of the second control signal;

wherein the second power voltage is lower than a second threshold voltage and the first power voltage is higher than the second power voltage.

17. The display device of claim 16, wherein the pixel driving circuit further comprises:

a second storage module, electrically connected to the first node, configured to store the first power voltage or the second power voltage.

18. The display device of claim 17, wherein the second storage module comprises:

a second capacitor, having one end electrically connected to the first node and another end electrically connected to a ground.

19. The display device of claim 16, wherein the second control module comprises:

a second transistor, having a gate receiving the second control signal, a source receiving the second power voltage, and a drain electrically connected to the first node.

20. The display device of claim 15, wherein the first control module comprises:

a first transistor, having a gate receiving the first control signal, a source receiving the first power voltage, and a drain electrically connected to the first node.

* * * * *